US006984787B2

(12) United States Patent
Mita et al.

(10) Patent No.: US 6,984,787 B2
(45) Date of Patent: Jan. 10, 2006

(54) SHIELD-PROCESSING STRUCTURE OF SHIELDED CABLE

(75) Inventors: Akira Mita, Haibara-gun (JP); Tetsuro Ide, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/888,504

(22) Filed: Jul. 12, 2004

(65) Prior Publication Data

US 2005/0056452 A1 Mar. 17, 2005

(30) Foreign Application Priority Data

Jul. 11, 2003 (JP) ..... P2003-273313

(51) Int. Cl.
*H01R 4/00* (2006.01)

(52) U.S. Cl. ..... 174/84 R; 174/94 R

(58) Field of Classification Search ..... 174/74 R, 174/78, 84 R, 84 C, 94 R; 29/872, 868
See application file for complete search history.

(56) References Cited

U.S. PATENT DOCUMENTS 5,584,122 A * 12/1996 Kato et al. ..... 29/872
5,869,784 A * 2/1999 Shinchi ..... 174/84 R
5,929,384 A * 7/1999 Ide et al. ..... 174/84 R
5,959,252 A * 9/1999 Ide et al. ..... 174/84 R
6,004,170 A * 12/1999 Kato et al. ..... 439/874
6,218,919 B1 * 4/2001 Ciarcia et al. ..... 335/167
6,291,771 B1 * 9/2001 Tanikawa et al. ..... 174/84 R
6,313,407 B1 * 11/2001 Shinchi et al. ..... 174/84 R
6,327,777 B1 * 12/2001 Ide et al. ..... 29/868
6,576,842 B2 * 6/2003 Ishii ..... 174/84 R
6,657,126 B2 * 12/2003 Ide et al. ..... 174/78

FOREIGN PATENT DOCUMENTS

JP 2001-6767 A 1/2001

* cited by examiner

*Primary Examiner*—William H. Mayo, III
(74) *Attorney, Agent, or Firm*—Sughrue Mion, PLLC

(57) ABSTRACT

In a shield-processing structure of a shielded cable 1, the shielded cable 1 and an earth cable 2 are held between two resin members 3 and 3, and ultrasonic vibration is applied to the resin members 3 and 3 while exerting a compressive force between the resin members 3 and 3, thereby forming a shield-processed portion. A shielded cable-receiving groove 15 and an earth cable-receiving groove 16 are formed in a joint surface 3*a* of each of the resin members 3 and 3, and earth cable-holding projections 17 are formed on each of the joint surfaces 3*a*, and is disposed adjacent to the shielded cable-receiving groove 15, and projects into the earth cable-receiving groove 16. Opposite end portions 17*a* and 17*a* of a distal end surface of each of the earth cable-holding projections 17 are higher than a central portion 17*b* thereof.

4 Claims, 11 Drawing Sheets

SHIELD-PROCESSING STRUCTURE OF SHIELDED CABLE

BACKGROUND OF THE INVENTION

1. Field of the Invention

This invention relates to a shield-processing structure of a shielded cable which is formed by ultrasonically welding the shielded cable and an earth cable together, using two resin members.

2. Related Art

One conventional shield-processing structure, using ultrasonic welding, is disclosed in Unexamined Japanese Patent Publication 2001-6767. This shield-processing structure is formed, using two resin members 50 and 51 shown respectively in FIGS. 7A and 7B. The resin members 50 and 51 have shielded cable-receiving grooves 50*b* and 51*b* of an arcuate shape formed respectively in their joint surfaces 50*a* and 51*a*, and a resin-flowing recess 50*c* is formed in the joint surface 50*a* while resin-flowing recesses 51*c* are formed in the joint surface 51*a*. The resin member 50 has earth cable-holding projections 50*d* (each having a flat distal end surface) each formed between the shielded cable-receiving groove 50*b* and the resin-flowing recess 50*c*, while the resin member 51 has earth cable-holding projections 51*d* (each having a flat distal end surface) each formed between the shielded cable-receiving groove 51*b* and the corresponding resin-flowing recess 51*c*.

Next, a shield-processing procedure will be described. An earth cable 53 is placed on a shielded cable 52 (having a conductor 52*a* covered at its outer periphery with a braided wire (shielding covering member) 52) in intersecting relation thereto, and that portion where the earth cable 53 is placed on the shielded cable 52 is held between the two resin members 50 and 51, and ultrasonic vibration is applied from an ultrasonic horn to the two resin members 50 and 51 while exerting a compressive force between the upper and lower resin members 50 and 51.

When the ultrasonic vibration is thus applied by the ultrasonic horn, the resin members 50 and 51, an outer insulating sheath 52*d* of the shielded cable 52 and an outer insulating sheath 53*b* of the earth cable 53 are melted by the vibration energy produced by application of the ultrasonic vibration, so that a conductor portion 53*a* of the earth cable 53 and the braided wire 52*c* of the shielded cable 52 are contacted with each other. When the melted portions are solidified after the application of ultrasonic vibration is finished, the two resin members 50 and 51 are integrally connected together, so that the shielded cable 52 and the earth cable 53 are joined together.

When the shielded cable 52 and the earth cable 53 are held between the two resin members 50 and 51 for the purpose of effecting the ultrasonic welding, the shielded cable 52 is received in the shielded cable-receiving grooves 50*b* and 51*b* of the resin members 50 and 51, while the earth cable 53 is pressed between each mating pair of earth cable-holding projections 50*d* and 51*d* of the resin members 50 and 51, and in this condition ultrasonic vibration is applied. Therefore, when the outer insulating sheath 53*b* of the earth cable 53 is melted by heat produced upon application of ultrasonic vibration, the conductor 53*a*, so far restrained by the outer insulation sheath 53*b*, is released, and can freely move over the flat earth cable-holding projections 50*d* and 51*d*. Therefore, the conductor 53*a* is disengaged from the earth cable-holding projections 50*d* and 5*d*, and are liable to become loose as shown in FIGS. 11 and 12. When the conductor 53*a* thus became loose, a cable-holding force to hold the shielded cable 52 and the earth cable 53 together was lowered. And besides, good contact between the conductor 53*a* and the braided wire 52*c* was not obtained, so that the electrical connection performance was lowered.

SUMMARY OF THE INVENTION

Therefore, this invention has been made in order to solve the above problems, and an object of the invention is to provide a shield-processing structure of a shielded cable in which troubles due to the disengagement of a conductor from earth cable-holding projections are prevented, thereby enhancing a cable-holding force to hold the shielded cable and an earth cable together and a performance of electrical connection between the two cables.

According to a first aspect of the present invention, there is provided a shield-processing structure of a shielded cable wherein the shielded cable, having a conductor covered at its outer periphery with a shielding covering member, and an earth cable, disposed in intersecting relation to the shielded cable, are held between two resin members; and ultrasonic vibration is applied to the resin members while exerting a compressive force between the resin members, so as to melt resin portions, thereby forming a portion of contact between the shielding covering member of the shielded cable and a conductor of the earth cable; provided in that a shielded cable-receiving groove for receiving the shielded cable and an earth cable-receiving groove for receiving the earth cable are formed in a joint surface of each of the resin members; and an earth cable-holding projection is formed on each of the joint surfaces, and is disposed adjacent to the shielded cable-receiving groove, and projects into the earth cable-receiving groove; and distal end surfaces of the earth cable-holding projections of the two resin members are disposed closer to each other at their opposite end portions than at their central portions.

In this shield-processing structure of the shielded cable, when the shielded cable and the earth cable are held between the two resin members in the ultrasonic welding operation, the earth cable is pressed between the earth cable-holding projections of the two resin members, and an outer insulating sheath of the earth cable and the earth cable-holding projections are melted upon application of ultrasonic vibration. In this melting process, the distal end surfaces of the earth cable-holding projections abut against each other earlier at their opposite end portions than at their central portions, thereby limiting the movement of the conductor of the earth cable, and therefore this conductor is prevented from spreading outwardly from the earth cable-holding projections by vibration.

The shield-processing structure of the shielded cable as defined in a second aspect of the present invention depending from the first aspect of the present invention is provided in that the opposite end portions of the distal end surface of each of the earth cable-holding projections are higher than the central portion thereof.

In this shield-processing structure of the shielded cable, similar effects to those of the first aspect of the present invention are obtained.

The shield-processing structure of the shielded cable as defined in a third aspect of the present invention depending from the first aspect of the present invention is provided in that one end portions of the distal end surfaces of the earth cable-holding projections which are disposed out of registry with each other are higher than the central portions thereof.

In this shield-processing structure of the shielded cable, similar effects to those of the invention of the first aspect of the present invention are obtained.

The shield-processing structure of the shielded cable as defined in a fourth aspect of the present invention depending from any one of the first to third aspect of the present invention is provided in that each of the joint surfaces has the earth cable-holding projections provided respectively at opposite sides of the shielded cable-receiving groove.

In this shield-processing structure of the shielded cable, the effects of the first to third aspect of the present invention are obtained, and in addition the spreading of the conductor of the earth cable is prevented at the opposite sides of the shielded cable.

As described above, in the first aspect of the present invention; the shielded cable-receiving groove for receiving the shielded cable and the earth cable-receiving groove for receiving the earth cable are formed in the joint surface of each of the two resin members, and the earth cable-holding projection is formed on each of the joint surfaces, and is disposed adjacent to the shielded cable-receiving groove, and projects into the earth cable-receiving groove, and the distal end surfaces of the earth cable-holding projections of the two resin members are disposed closer to each other at their opposite end portions than at their central portions. Therefore, when the shielded cable and the earth cable are held between the two resin members in the ultrasonic welding operation, the earth cable is pressed between the earth cable-holding projections of the two resin members, and the outer insulating sheath of the earth cable and the earth cable-holding projections are melted upon application of ultrasonic vibration. In this melting process, the distal end surfaces of the earth cable-holding projections abut against each other earlier at their opposite end portions than at their central portions, thereby limiting the movement of the conductor of the earth cable. Therefore, this conductor is prevented from spreading outwardly from the earth cable-holding projections by vibration. Therefore, the conductor will not be disengaged from the earth cable-holding projections, but contacts the shielding covering member of the shielded cable in a bundled condition. Therefore, a cable holding force to hold the shielded cable and the earth cable together, as well as the performance of electrical connection between the two cables, is enhanced.

In the second aspect of the present invention, the opposite end portions of the distal end surface of each of the earth cable-holding projections are higher than the central portion thereof, and therefore similar effects to those of the first aspect of the present invention are obtained.

In the third aspect of the present invention, one end portions of the distal end surfaces of the earth cable-holding projections which are disposed out of registry with each other are higher than the central portions thereof, and therefore similar effects to those of the first aspect of the present invention are obtained.

In the fourth aspect of the present invention, each of the joint surfaces has the earth cable-holding projections provided respectively at the opposite sides of the shielded cable-receiving groove, and therefore the spreading of the conductor of the earth cable is prevented at the opposite sides of the shielded cable. Therefore, the cable holding force to hold the shielded cable and the earth cable together, as well as the performance of electrical connection between the two cables, is further enhanced.

BRIEF DESCRIPTION OF THE DRAWINGS

FIG. 7 shows a conventional example.

DETAILED DESCRIPTION OF THE PREFERRED EMBODIMENTS

A preferred embodiment of the present invention will now be described with reference to the drawings.

Figure 1:
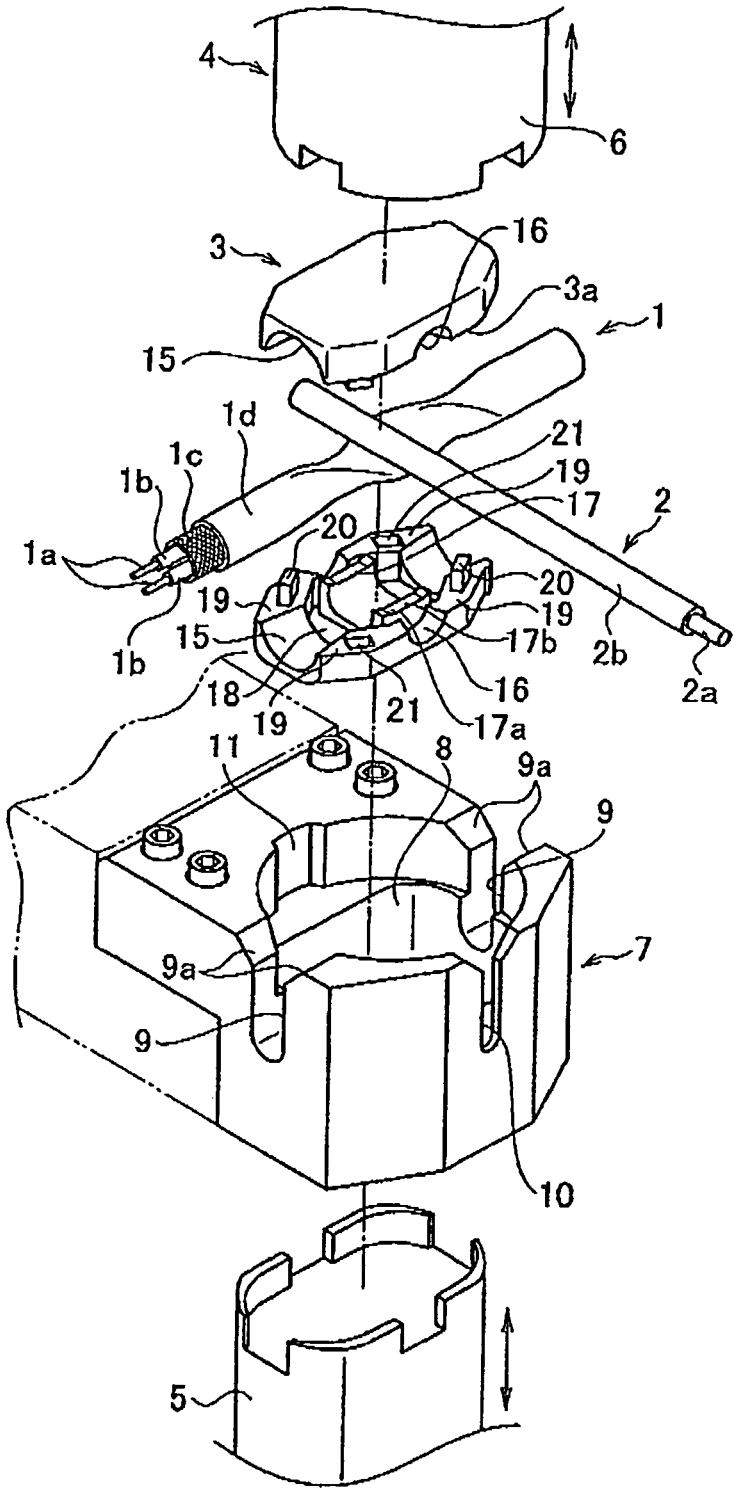
FIG. 1 shows a first embodiment of the invention, and is an exploded perspective view explanatory of a shield-processing method.

As shown in FIG. 1 of a first embodiment, a shielded cable 1 comprises two conductors 1*a* and 1*a* twisted together, inner insulating sheaths 1*b* and 1*b* which are made of a resin, and cover outer peripheries of the conductors 1*a* and 1*a*, respectively, a braided wire 1*c* (serving as a shielding covering member) covering outer peripheries of the inner insulating sheaths 1*b* and 1*b*, and an outer insulating sheath 1*d* covering an outer periphery of the braided wire 1*c*.

The earth cable 2 comprises the conductor 2*a*, and an outer insulating sheath 2*b* which is made of a resin, and covers an outer periphery of the conductor 2*a*.

Figure 2:
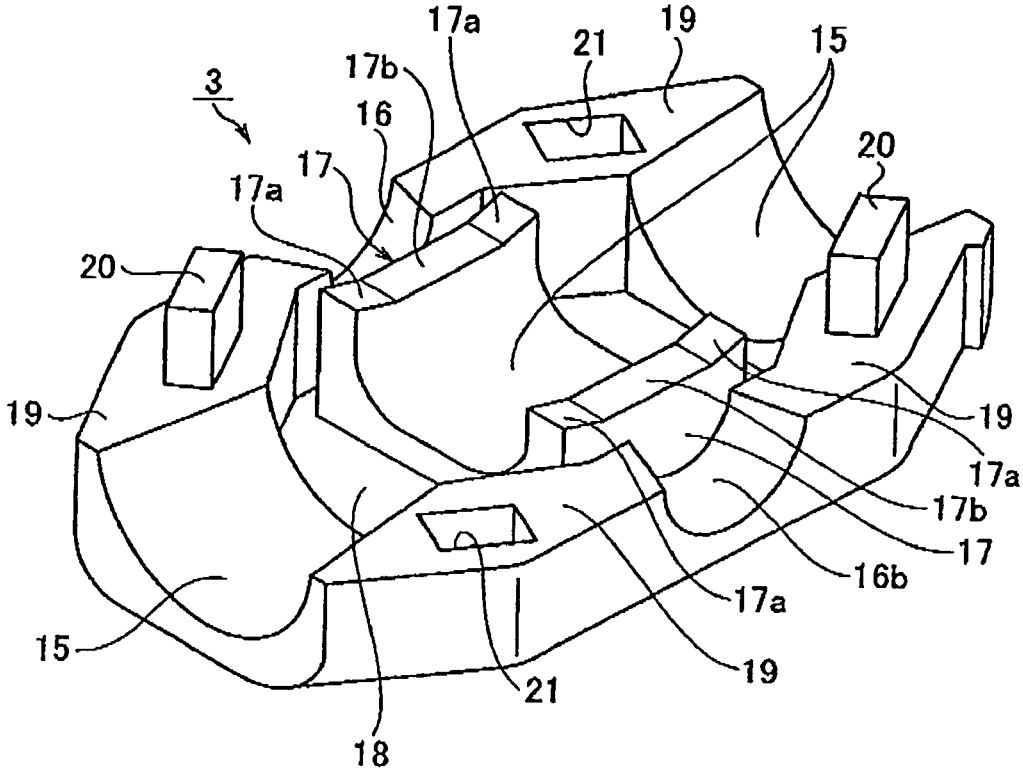
FIG. 2 shows the first embodiment of the invention, and is a perspective view of a resin member.

As shown in FIGS. 1 and 2, the pair of resin members 3 and 3 are of the same construction, and each of the resin members 3 has a joint surface 3*a*. A shielded cable-receiving groove 15 of a generally arcuate shape for receiving the shielded cable 1, as well as an earth cable-receiving groove 16 of a generally arcuate shape for receiving the earth cable 2, is formed in each joint surface 3*a*. The shielded cable-receiving groove 15 and the earth cable-receiving groove 16 are arranged to perpendicularly intersect each other. The earth cable-holding projections 17 are formed on each joint surface 3*a*, and are disposed adjacent respectively to opposite sides of the shielded cable-receiving groove 15, and project into the earth cable-receiving groove 16. Opposite end portions 17*a* of a distal end surface of each earth cable-holding projection 17 are higher than a central portion 17*b* thereof. The opposite end surfaces 17*a* and 17*a* are defined respectively by slanting surfaces each increasing in height gradually from its inner end toward its outer (distal) end. With this construction, the opposed distal end surfaces of the mating pair of earth cable-holding projections 17 and 17 of the two resin members are disposed closer to each other at their opposite end portions 17*a* than at their central portions 17*b*.

A resin-flowing recess 18 of a generally annular shape is formed in each joint surface 3*a*, and is disposed around the earth cable-holding projections 17. The resin-flowing recess 18 is provided so that molten resin of the earth cable-holding projections 17 and others can flow into this resin-flowing recess 18, thereby preventing the molten resin from flowing outwardly from the pair of upper and lower resin members 3 and 3.

Outer marginal surfaces 19 are formed respectively at four portions (disposed on diagonal lines) of the resin member disposed outwardly of the resin-flowing recess 18. Projections 20 are formed respectively on the outer marginal surfaces 19 disposed on one diagonal line, while holes 21 are formed respectively in the outer marginal surfaces 19 disposed on the other diagonal line. Namely, when the pair of upper and lower resin members 3 and 3 are mated with each other at their joint surfaces 3*a* and 3*a*, the projections 20 of each resin member 3 are inserted respectively into the holes 21 in the mating resin member 3, so that the two resin members 3 are combined together.

As shown in FIG. 2, a resin-flowing groove (not shown) is formed in a bottom surface of each hole 21. These resin-flowing grooves are provided so that a molten resin of the projections 20 and others can flow into these resin-flowing grooves, thereby preventing the molten resin from flowing outwardly from the pair of upper and lower resin members 3 and 3. Furthermore, the bottom surface of each hole 21 is formed as a slanting surface, and therefore when a distal end surface of the projection 20 abuts against the bottom surface of the hole 21, the two are held in line contact with each other.

Figure 3:
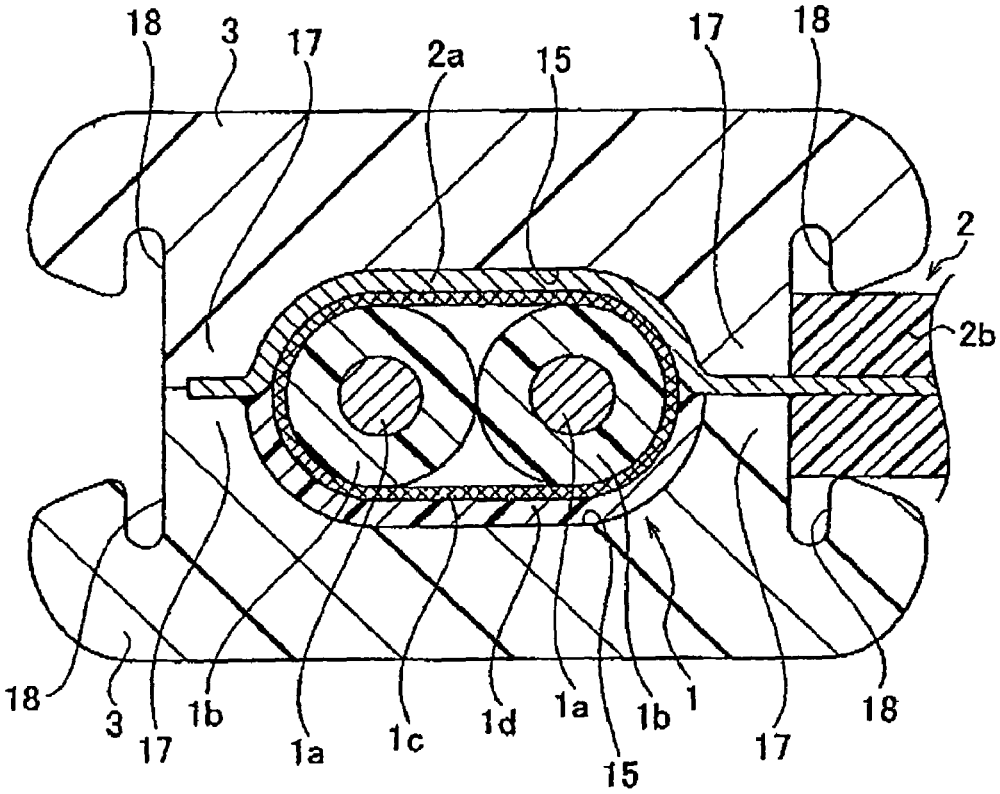
FIG. 3 shows the first embodiment of the invention, and is a cross-sectional view of an ultrasonically-welded portion.
Figure 4:
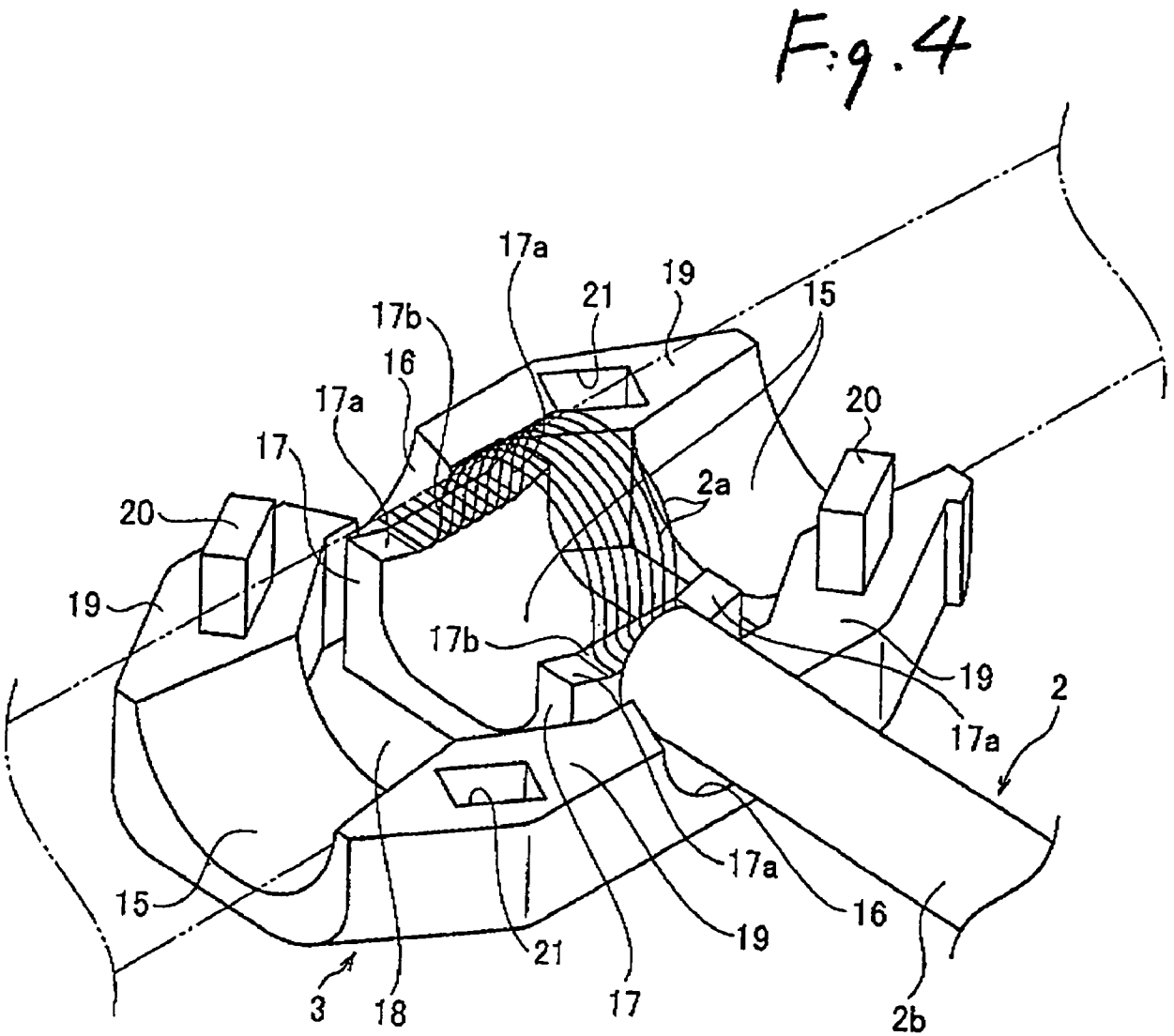
FIG. 4 shows the first embodiment of the invention, and is a perspective view showing a condition in which a conductor of an earth cable is not spread out, but is disposed in a bundled condition.
Figure 5:
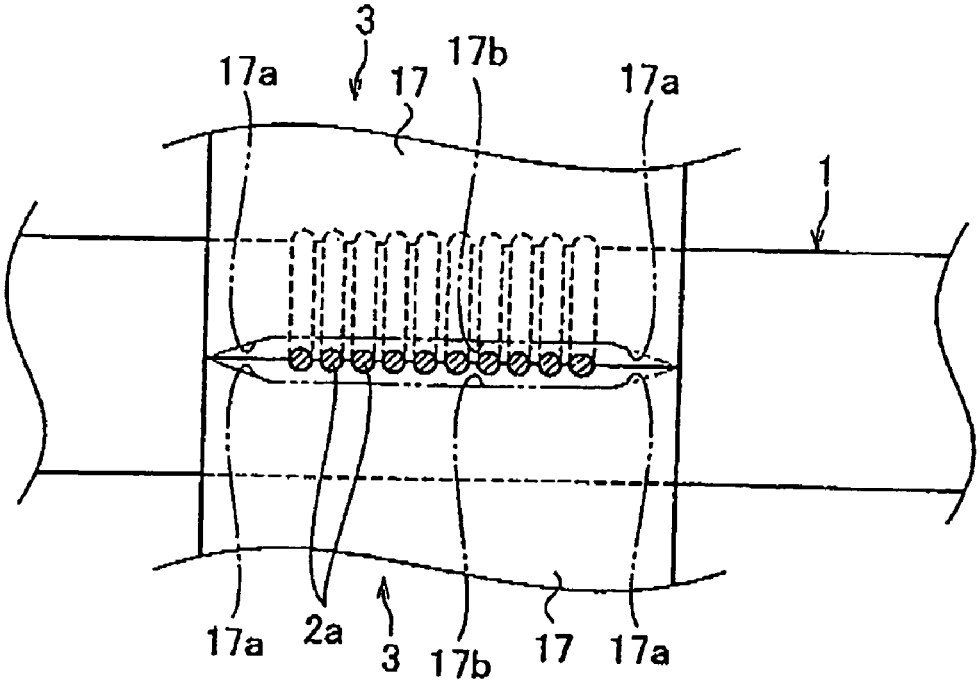
FIG. 5 shows the first embodiment of the invention, and is a side-elevational view showing a condition in which the conductor of the earth cable is not spread out, but is kept bundled by earth cable-holding projections of the two resin members.

When ultrasonic vibration is to be applied, the shielded cable 1 and the earth cable 2 are held between the pair of upper and lower resin members 3 and 3, and in this condition the surfaces of the shielded cable-receiving grooves 15 and 15 of the two resin members are held in intimate contact with the shielded cable 1, while the surfaces of the earth cable-receiving grooves 16 and 16 of the two resin members are held in intimate contact with the earth cable 2 as shown in FIG. 3, and also each projection 20 is held in intimate contact with the bottom surface of the corresponding hole 21.

As shown in FIG. 1, an ultrasonic horn 4 comprises a lower support base 5, and an ultrasonic horn body 6 located right above this lower support base 5 so as to produce ultrasonic vibrations. The lower support base 5 and the ultrasonic horn body 6 are so provided that they can move upward and downward separately from each other. The resin member 3 can be set on an upper surface of the lower support base 5, and the thus set resin member 3 is held in this condition, with its joint surface 3*a* facing upwardly. The other resin member 3 can be set at a lower surface of the ultrasonic horn body 6, and the thus set resin member 3 is held in this condition, with its joint surface 3*a* facing downwardly.

A shield-processing jig 7 has a resin-mounting opening 8 extending vertically therethrough, and a pair of cable insertion grooves 9 and 9 are formed respectively in right and left portions of this jig 17 disposed outwardly of the resin-mounting opening 8. The distance between the pair of cable insertion grooves 9 and 9 is substantially equal to a half of a pitch P of twisting of the conductors 1*a* and 1*a* (that is, P/2), and each of these grooves 9 has such a width that the two conductors 1*a* and 1*a* (twisted together) are allowed to be inserted or fitted into the groove 9 only at their portions arranged parallel to each other in the vertical direction. In this embodiment, the twist pitch P is about 30 mm. An inlet portion of each of the cable insertion grooves 9 and 9 is defined by tapering surfaces 9*a* and 9*a*, and is decreasing in width gradually in the cable inserting direction.

An earth cable insertion groove 10 and a reference recess 11 are formed in the shield-processing jig 7, and are disposed outwardly of the resin-mounting opening 8, and are disposed on a line perpendicularly intersecting a line interconnecting the pair of cable insertion grooves 9 and 9. The earth cable 2, when inserted into the earth cable insertion groove 10, is set in a middle position between the pair of cable insertion grooves 9 and 9.

Next, the shield-processing method, using the shield-processing jig 7, will be described.

As shown in FIG. 1, the resin members 3 and 3 are set at the lower surface of the ultrasonic horn body 6 and the upper surface of the lower support base 5, respectively. The shielded cable 1 is inserted into the pair of cable insertion grooves 9 and 9 in the shield-processing jig 7. Here, the shielded cable 1 can be inserted into the cable insertion grooves 9 and 9 only at those portions thereof where the two conductors 1*a* and 1*a* (twisted together) are arranged parallel to each other in the vertical direction.

Then, the earth cable 2 is inserted into the earth cable insertion groove 10 in the shield-processing jig 7, and is inserted to be advanced until the distal end of the earth cable 2 is brought into a butting engagement with the reference recess 11. As a result, the earth cable 2 is substantially held in contact with the upper surface of the shielded cable 1, and is disposed in intersecting relation to the shielded cable 1.

Then, the earth cable 2 is pulled back in such a predetermined amount that the distal end of the earth cable 2 will not project outwardly from the pair of upper and lower resin members 3 and 3, and the lower support base 5 is moved upward while the ultrasonic horn body 6 is moved downward, so that the joint surfaces 3*a* and 3*a* of the pair of upper and lower resin members 3 and 3 are mated with each other. As a result, the pair of upper and lower resin members 3 and 3 hold the shielded cable 1 and the earth cable 2 therebetween, and the shielded cable 1 is fitted between the shielded cable-receiving grooves 15 and 15 of the two resin members while the earth cable 2 is fitted between the earth cable-receiving grooves 16 and 16 of the two resin members. The projections 20 of each of the two resin members 3 and 3 are inserted respectively into the holes 21 of the corresponding resin member 3, so that the pair of resin members 3 and 3 are positioned relative to each other.

Then, ultrasonic vibration is applied to the two resin members while exerting a compressive force between the ultrasonic horn body 6 and the lower support base 5. As a result, the outer insulating sheath 1*d* of the shielded cable 1 and the outer insulating sheath 2*b* of the earth cable 2 are melted and dissipated by heat produced by the vibration energy, so that the conductor 2*a* of the earth cable 2 contacts the braided wire 1*c* of the shielded cable 1. Also, the portions of contact between the joint surfaces 3*a* and 3*a* of the pair of resin members 3 and 3, the portions of contact between the surfaces of the shielded cable-receiving grooves 15 and 15 (formed respectively in the pair of resin members 3 and 3) and the outer insulating sheath 1*d* of the shielded cable 1, and the portions of contact between the surfaces of the earth cable-receiving grooves 16 and 16 (formed respectively in the pair of resin members 3 and 3) and the outer insulating sheath 2*b* of the earth cable 2 are melted by the heat produced by the vibration energy, and these molten portions are solidified after the application of ultrasonic vibration is finished, so that the pair of resin members 3 and 3, the shielded cable 1 and the earth cable 2 are fixed to one another (see FIG. 3).

Next, the welding of the earth cable 2 during the application of ultrasonic vibration will be described.

When the shielded cable 1 and the earth cable 2 are held between the pair of upper and lower resin members 3 and 3, the earth cable 2 is pressed between each mating pair of earth cable-holding projections 17 and 17 of the two resin members 3 and 3, and the outer insulating sheath 2*b* of the earth cable 2 and each mating pair of the earth cable-holding projections 17 and 17 are melted upon application of ultrasonic vibration. In this melting process, the distal end surfaces of the mating earth cable-holding projections 17 and 17 abut against each other earlier at their opposite end portions 17*a* than at their central portions 17*b*, thereby limiting the movement of the conductor 2*a* of the earth cable 2, and therefore the conductor 2*a* is prevented from spreading outwardly from the earth cable-holding projections 17 and 17 by vibration. Therefore, the conductor 2*a* is not disengaged from the earth cable-holding projections 17, but contacts the shielding covering member 1*c* of the shielded cable 1 in a bundled condition. Therefore, the cable holding force to hold the shielded cable 1 and the earth cable 2 together, as well as the performance of electrical connection between the two cables, is enhanced.

In this first embodiment, the earth cable-holding projections 17 are provided at the opposite sides of the shielded cable-receiving groove 15, respectively, and therefore the spreading of the conductor 2*a* of the earth cable 2 is prevented at the opposite sides of the shielded cable 1, and the conductor 2*a* contacts the braided wire 1*c* in a bundled condition, so that the cable holding force to hold the shielded cable 1 and the earth cable 2 together, as well as the performance of electrical connection between the two cables, is further enhanced.

Figure 6:
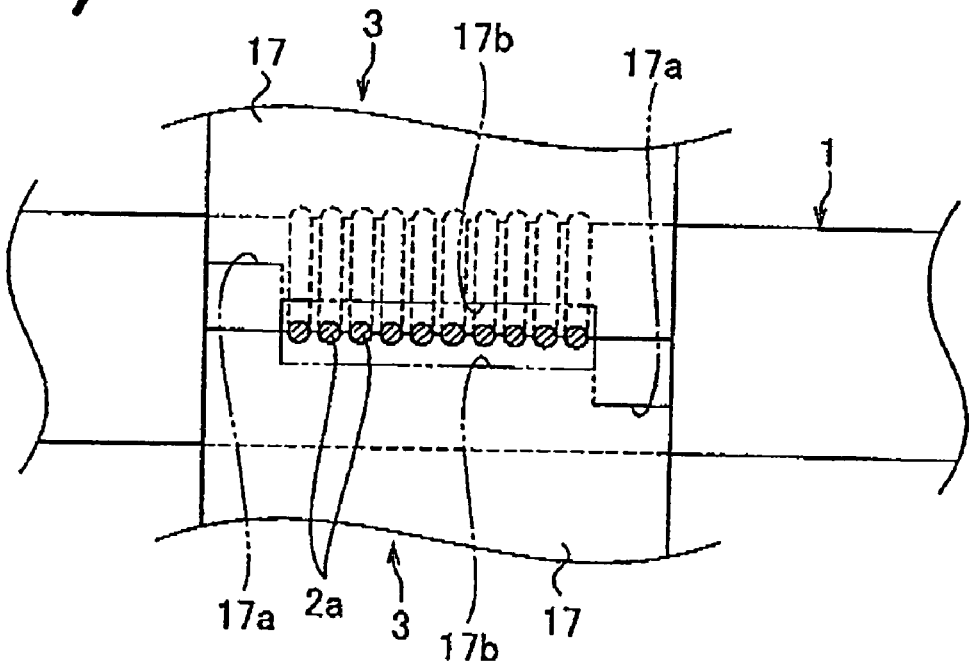
FIG. 6 shows a second embodiment of the invention, and is a side-elevational view showing a condition in which a conductor of an earth cable is not spread out, but is kept bundled by earth cable-holding projections of two resin members.
Figure 7A:
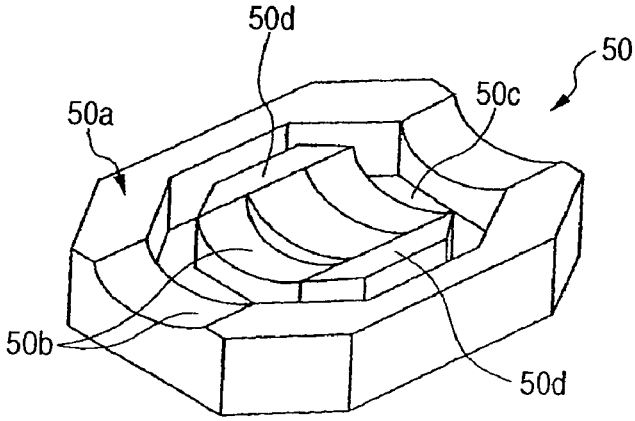
FIG. 7A is a perspective view of a resin member to be disposed at an upper side.
Figure 7B:
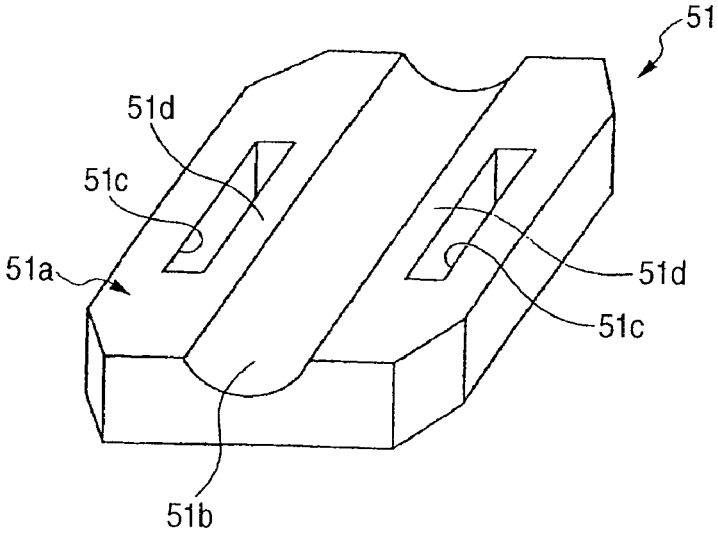
FIG. 7B is a perspective view of a resin member to be disposed at a lower side.
Figure 8:
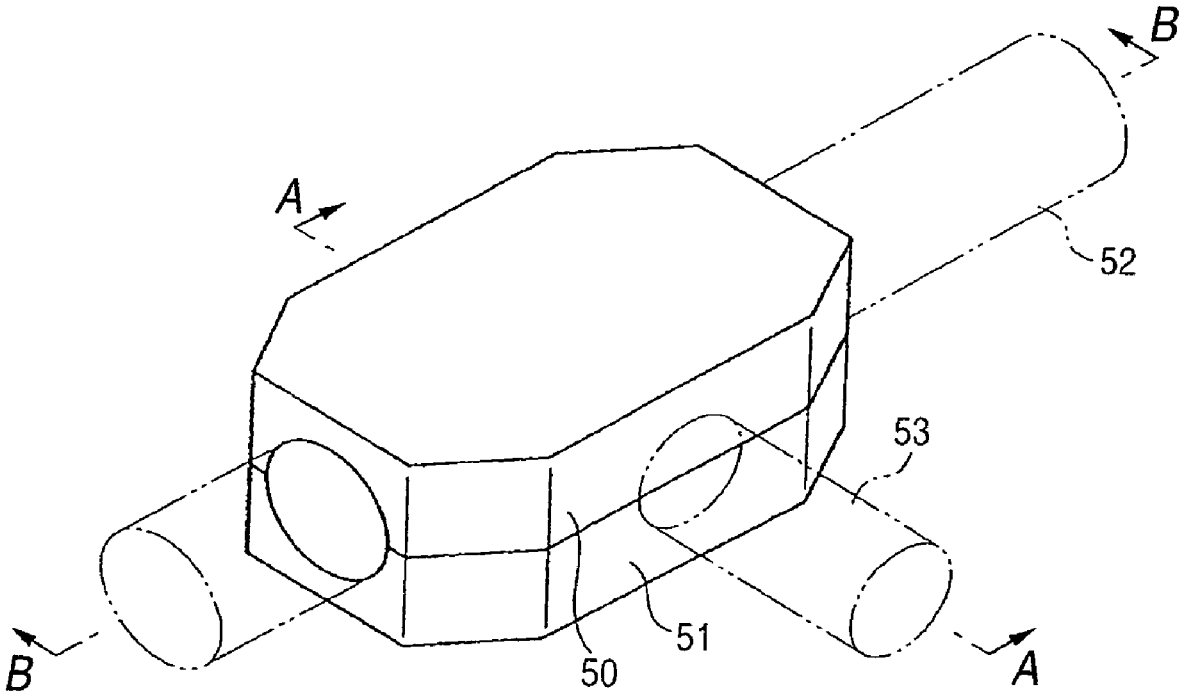
FIG. 8 shows the conventional example, and is a perspective view of an ultrasonically-welded portion.
Figure 9:
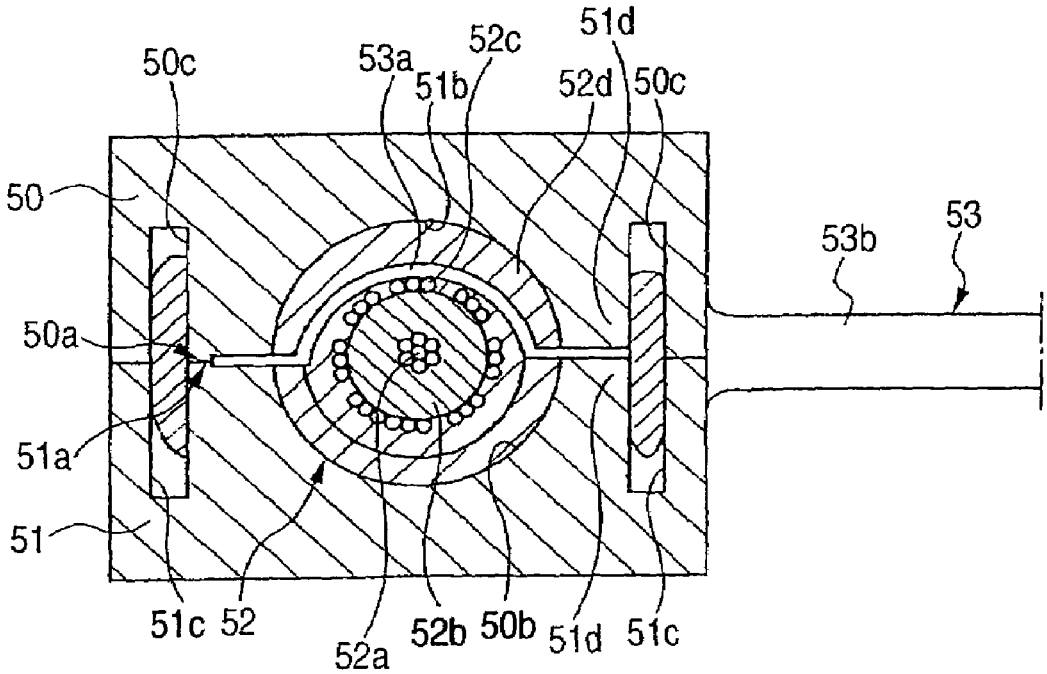
FIG. 9 shows the conventional example, and is a cross-sectional view taken along the line A—A of FIG. 8.
Figure 10:
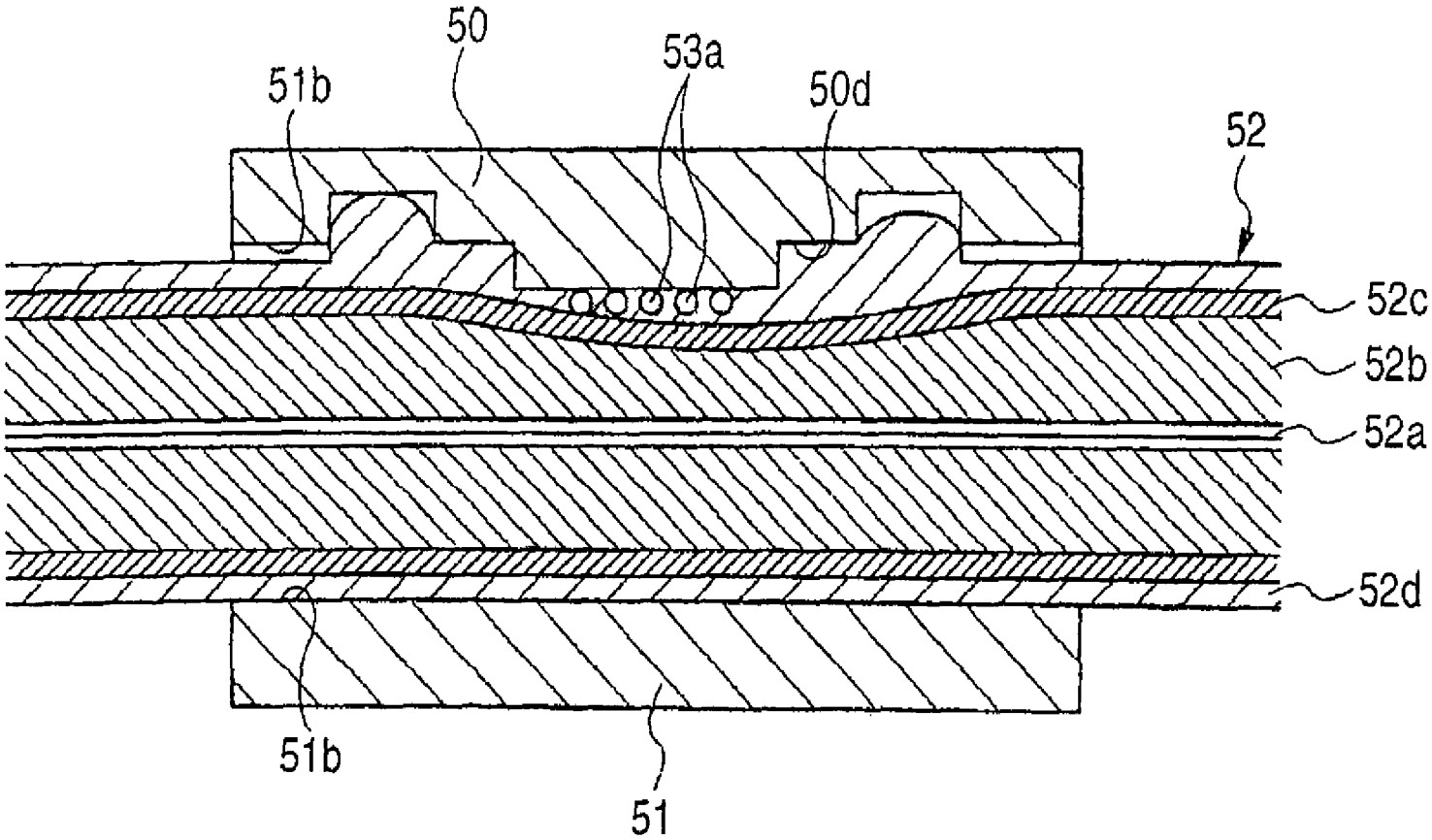
FIG. 10 shows the conventional example, and is a cross-sectional view taken along the line B—B of FIG. 8.
Figure 11:
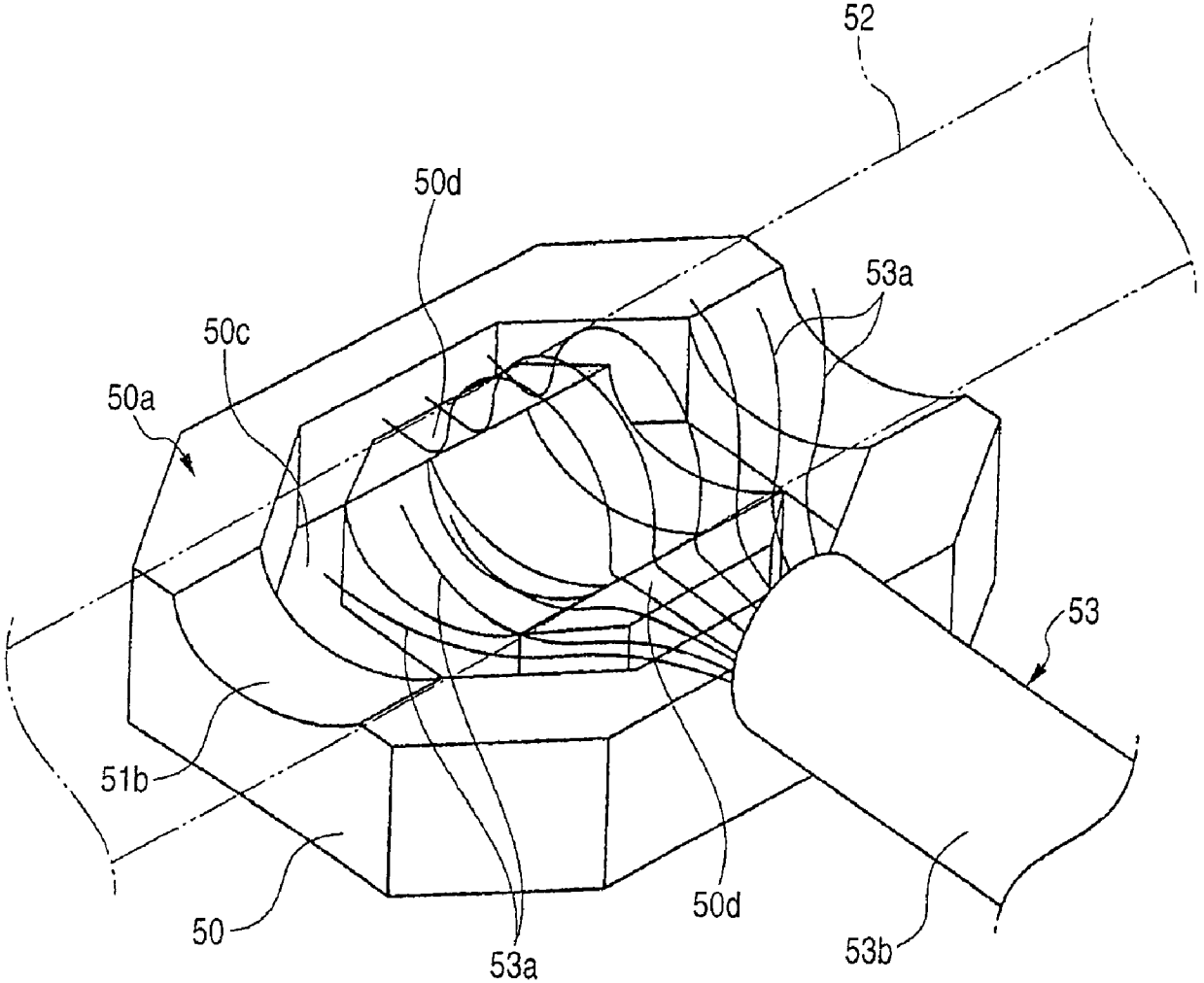
FIG. 11 shows the conventional example, and is a perspective view showing a condition in which a conductor of an earth cable is spread out.
Figure 12:
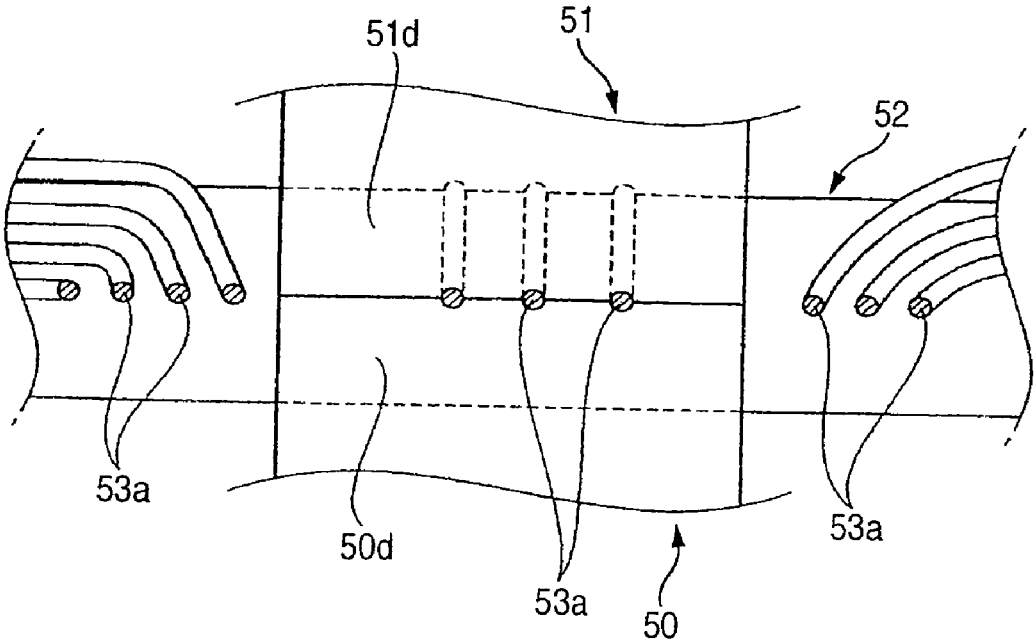
FIG. 12 shows the conventional example, and is a side-elevational view showing a condition in which the conductor of the earth cable is spread out by earth cable-holding projections of two resin members.

FIG. 6 shows a second embodiment of the invention, and is a side-elevational view showing a condition in which a conductor of an earth cable is not spread out, but is kept bundled by earth cable-holding projections of two resin members.

In this second embodiment, the earth cable-holding projections 17 and 17 are formed on a joint surface of each of the pair of resin members 3 and 3 as in the first embodiment, and one end portions 17*a* (which are disposed out of registry with each other) of distal end surfaces of each mating pair of earth cable-holding projections 17 and 17 of the two resin members 3 and 3 are higher than central portions 17*b* thereof as indicated in imaginary lines in FIG. 6. With this construction, the mating pair of earth cable-holding projections 17 and 17 of the two resin members are disposed closer to each other at their opposite end portions 17*a* than at their central portions 17*b*. The other construction is similar to that of the first embodiment, and therefore detailed explanation thereof will be omitted.

In this second embodiment, also, during the melting process, the distal end surfaces of the mating earth cable-holding projections 17 and 17 abut against each other earlier at their opposite end portions 17*a* than at their central portions 17*b*, thereby limiting the movement of the conductor 2*a* of the earth cable 2, and therefore the conductor 2*a* is prevented from spreading outwardly from the earth cable-holding projections 17 and 17 by vibration. Therefore, the conductor 2*a* will not be disengaged from the earth cable-holding projections 17, but contacts a shielding covering member of a shielded conductor 1 in a bundled condition. Therefore, the cable holding force to hold the shielded cable 1 and the earth cable 2 together, as well as the performance of electrical connection between the two cables, is enhanced.

In the above embodiments, although the shielding covering member of the shielded cable 1 comprises the braided wire 1*c*, it may comprise any other suitable electrically-conductive member in so far as it can cover the two inner insulating sheaths 1*b* and 1*b* substantially over the entire periphery thereof. For example, an electrically-conductive metal foil may be used to form the shielding covering member. Although the above description has been directed to the shield-processing structure in which the shielded cable 1, having the two conductors 1*a* and 1*a* (twisted together), is subjected to the shield-processing, the invention can be applied also to a shielded cable having one or more than two conductors 1*a* and to a shielded cable having conductors which are not twisted together.

What is claimed is:

1. A shield-processing structure of a shielded cable comprising:

a shielded cable, including a conductor covered at its outer periphery with a shielding covering member;

an earth cable;

two resin members which hold the shielded cable and the earth cable to be disposed in intersecting relation thereto;

a shielded cable-receiving groove for receiving said shielded cable and an earth cable-receiving groove for receiving said earth cable, said shielded cable-receiving groove and said earth cable-receiving groove formed in a joint surface of each of said resin members; and an earth cable-holding projection which is formed on each of said joint surfaces in such a manner that said earth cable-holding projection is disposed adjacent to said shielded cable receiving groove, and projects into said earth cable-receiving groove, wherein distal end surfaces of said earth cable-holding projections of said two resin members are disposed closer to each other at their opposite end portions than at their central portions.

2. A shield-processing structure of a shielded cable according to claim 1, wherein the opposite end portions of the distal end surface of each of said earth cable-holding projections are higher than the central portion thereof.

3. A shield-processing structure of a shielded cable according to claim 1, wherein one end portions of the distal end surfaces of said earth cable-holding projections which are disposed out of registry with each other are higher than the central portions thereof.

4. A shield-processing structure of a shielded cable according to claim 1, wherein each of said joint surfaces has said earth cable-holding projections provided respectively at opposite sides of said shielded cable-receiving groove.

* * * * *